US010879577B2

(12) United States Patent
Capet et al.

(10) Patent No.: US 10,879,577 B2
(45) Date of Patent: Dec. 29, 2020

(54) MULTILAYER WAVEGUIDE COMPRISING AT LEAST ONE TRANSITION DEVICE BETWEEN LAYERS OF THIS MULTILAYER WAVEGUIDE

(71) Applicants: Centre National d'Etudes Spatiales CNES, Paris (FR); LE CENTRE NATIONAL DE LA RECHERCHE SCIENTIFIQUE, Paris (FR); L'UNIVERSITE DE RENNES 1, Rennes (FR)

(72) Inventors: Nicolas Capet, Toulouse (FR); Francesco Foglia Manzillo, Rennes (FR); Karim Tekkouk, Tokyo (JP); Ronan Sauleau, Acigne (FR); Mauro Ettorre, Rennes (FR)

(73) Assignees: CENTRE NATIONAL D'ETUDES SPATIALES CNES, Paris (FR); LE CENTRE NATIONAL DE LA RECHERCHE SCIENTIFIQUE, Paris (FR); L'UNIVERSITE DE RENNES 1, Rennes (FR)

( * ) Notice: Subject to any disclaimer, the term of this patent is extended or adjusted under 35 U.S.C. 154(b) by 0 days.

(21) Appl. No.: 16/343,258

(22) PCT Filed: Oct. 16, 2017

(86) PCT No.: PCT/EP2017/076359

§ 371 (c)(1),
(2) Date: Apr. 18, 2019

(87) PCT Pub. No.: WO2018/073176

PCT Pub. Date: Apr. 26, 2018

(65) Prior Publication Data

US 2019/0319327 A1 Oct. 17, 2019

(30) Foreign Application Priority Data

Oct. 21, 2016 (FR) ..... 16 60249

(51) Int. Cl.
*H01P 3/16* (2006.01)
*H01P 5/02* (2006.01)

(52) U.S. Cl.
CPC ..... *H01P 3/16* (2013.01); *H01P 5/022* (2013.01)

(58) Field of Classification Search
CPC .. H01P 3/16; H01P 5/022; H01P 5/024; H01P 1/042; H01P 3/121; H04B 5/00; H05K 1/144; H01Q 13/06
(Continued)

(56) References Cited

U.S. PATENT DOCUMENTS

| | | | |
|---|---|---|---|
| 2012/0206311 | A1 | 8/2012 | Lee et al. |
| 2013/0012145 | A1 | 1/2013 | Shibuya et al. |
| 2015/0303541 | A1 | 10/2015 | Murata et al. |

FOREIGN PATENT DOCUMENTS

| | | |
|---|---|---|
| EP | 1783855 | 5/2007 |
| FR | 2778024 | 10/1999 |

OTHER PUBLICATIONS

International Search Report for International Application PCT/EP2017/076359, dated Jan. 16, 2018.

*Primary Examiner* — Robert J Pascal
*Assistant Examiner* — Kimberly E Glenn
(74) *Attorney, Agent, or Firm* — Burris Law, PLLC

(57) ABSTRACT

The present disclosure relates to a multilayer electromagnetic waveguide that includes a plurality of layers forming guide channels for an electromagnetic wave, and at least one transition device including at least one dielectric layer between two guide channels, referred to as coupled guide channels, extending as an extension. Each transition device
(Continued)

includes at least one adaptation channel extending in a longitudinal direction, and each adaptation channel is defined by two electrically conductive walls. At least one wall extends along the dielectric spacer layer from one end of the coupled guide channel, over a length suitable for optimizing the transmission of an electromagnetic wave between the two coupled guide channels.

12 Claims, 9 Drawing Sheets

(58) Field of Classification Search
USPC ..... 333/239
See application file for complete search history.

MULTILAYER WAVEGUIDE COMPRISING AT LEAST ONE TRANSITION DEVICE BETWEEN LAYERS OF THIS MULTILAYER WAVEGUIDE

CROSS-REFERENCE TO RELATED APPLICATIONS

This application is a 371 of International Application No. PCT/EP2017/076359, filed on Oct. 16, 2017, which claims priority to and the benefit of FR 16/60249 filed on Oct. 21, 2016. The disclosures of the above applications are incorporated herein by reference.

FIELD

The present disclosure relates to a multilayer waveguide.

BACKGROUND

The statements in this section merely provide background information related to the present disclosure and may not constitute prior art.

There are known different structures of multilayer waveguides. In particular, the different layers may be formed by plates of printed circuit boards held assembled together by assembly devices such as adhesive films (assembly interlayers) or screws. In particular, such multilayer waveguides may be used to make antennas.

In order to guide electromagnetic waves between distinct layers of a multilayer waveguide, at least two guide channels, called coupled guide channels, extending respectively in two distinct layers separated from each other by a dielectric interlayer each have an opening, the two openings of the two coupled guide channels facing each other and allowing transmitting an electromagnetic wave through said dielectric interlayer and between these two coupled guide channels.

The publication «A Series Slot Array Antenna for 45°—Inclined Linear Polarization With SIW Technology» Dongyeon Kim et al., IEEE TRANSACTIONS ON ANTENNAS AND PROPAGATION, VOL. 60, NO. 4, APRIL 2012 describes a waveguide comprising two plates of a printed circuit board (PCB) superimposed by an adhesive film, each of the plates of a printed circuit board having a network of coupling slots and channels formed in rows, parallel to each other, of metallic vias formed across the thickness of the plates.

In practice, the number of superimposed layers of a multilayer waveguide formed by etching and stacking of plates of printed circuit boards is limited, in practice from 10 to 20 layers depending on the implemented technologies.

The electromagnetic waves guided in these known multilayer waveguides undergo energy losses during their transmission between two coupled guided channels result in particular in a poor electrical contact, and even in the absence of electrical contact, between the coupled guide channels. In particular, the poor contact between the coupled guide channels result in a reflection of the electromagnetic waves and may be at the origin of parasitic radiations and energy losses, these drawbacks being amplified in the case of a defect of alignment of the coupled guide channels during the manufacture of the multilayer waveguide.

Furthermore, the publications "Multibeam Pillbox Antenna With Low Sidelobe Level and High-Beam Crossover in SIW Technology Using the Split Aperture Decoupling Method", Karim Tekkouk, Mauro Ettorre, Erio Gandini and Ronan Sauleau, IEEE Trans. Antennas Propag., vol. 63, no. 11, 2015 and "Multi-beam multi-layer leaky-wave siw pillbox antenna for millimeter-wave applications", M. Ettorre, R. Sauleau and L. Le Coq, IEEE Trans. Antennas Propag., vol. 59, no. 4, pp. 1093-1100, April 2011 propose multilayer waveguides ensuring the electrical contact between the coupled guide channels but are suitable only for a limited number of layers. In addition, the stacking of these superimposed layers becomes complicated when the number of superimposed layers increases.

Moreover, US 2015/0303541 describes a connection between a first waveguide with a first plate of a printed circuit board and a second waveguide with a second plate of a printed circuit board. The two waveguides are formed by vias. The first waveguide has an opening on a face of the first plate facing an opening of the second waveguide on a face of the second plate. The connection comprises an insulating film disposed between the two plates of a printed circuit board. Furthermore, a metallic layer is disposed over the entire face of each plate having the opening of the waveguide on each side of the insulating film. The insulating film allows improving the transmission of the electromagnetic waves. In particular, the insulating film is constituted by a material deformable under the effect of a pressure so that the insulating film has a shape which adapts to the defects of the plates and to avoid a presence of a vacuum between these two plates in order to improve the connection between the first waveguide and the second waveguide.

These and other issues are addressed by the present disclosure.

SUMMARY

Hence, the present disclosure aims at providing a multilayer waveguide allowing ensuring an optimal transmission of the power of an electromagnetic wave guided between two layers of this multilayer waveguide.

Hence, the present disclosure aims at providing such a multilayer waveguide in which the electromagnetic energy transmission losses between coupled guide channels is minimized or reduced.

The present disclosure also aims at providing such a multilayer waveguide with a simple and inexpensive structure.

The present disclosure also aims at providing such a multilayer waveguide which is tolerant to manufacturing defects.

The present disclosure also aims at providing such a multilayer waveguide comprising a transition device between layers of this multilayer waveguide allowing increasing the number of layers of this multilayer waveguide.

For this purpose, the present disclosure concerns a multilayer electromagnetic waveguide comprising several superimposed layers forming channels for guiding an electromagnetic wave, and at least one transition device comprising at least one dielectric interlayer between two guide channels, called coupled guide channels, extending according to a direction of transmission of an electromagnetic wave between these coupled guide channels via the transition device, characterized in that:

each transition device comprises at least one adaption channel extending from the coupled guide channels, according to a longitudinal direction secant to the transmission direction, each adaptation channel is delimited by at least two electrically-conductive walls, called adaptation walls, spaced from each other by said dielectric interlayer of said transition device, each adaptation wall extending according to the longitudinal direction along said dielectric interlayer from one end, called coupling end, of a coupled guide channel, and at least one adaptation wall extending according to the longitudinal direction over a length selected so as to obtain an impedance, called input impedance, at least substantially zero between the adaptation walls of this adaptation channel at the level of the coupling ends of the coupled guide channels to optimize the transmission of an electromagnetic wave between the two coupled guide channels.

More particularly, the coupled guide channels extend according to said transmission direction at the level of the transition device. Thus, in some forms, the coupled guide channels extend according to the same axis oriented according to said transmission direction. In other forms, the coupled guide channels extend according to said transmission direction but extend according to an axis secant to said transmission direction. For example, in some forms, two coupled guide channels extend perpendicularly with respect to each other.

In particular, the length of each adaptation channel of a waveguide according to the present disclosure depends on the characteristics of the electromagnetic wave to be transmitted and on the characteristics of said dielectric interlayer.

In particular, phenomena of fringing fields and of radiation effects occur at the ends of each adaptation channel opposite to the guide channels and may be represented by a finite and non-zero load, called terminal load, equivalent to a resistance in parallel with a capacitor at this end of the adaptation channel.

In particular, the length of at least one adaptation wall of each adaptation channel is selected so as to reduce the insertion losses of the transition device. More particularly, the shortest adaptation wall of each adaptation channel is that whose length has to be adapted. Nevertheless, there is nothing to prevent from adapting the length of each adaptation wall of an adaptation channel.

In particular, the input impedance of an adaptation channel is the impedance of the terminal load brought at the input of the adaptation channel. In general, the value of the impedance of the terminal load depends on the thickness and on the permittivity of the dielectric interlayer and on the permittivity of the superimposed layers forming guide channels.

Thus, the length of each adaptation channel is adjusted so as to obtain an impedance which is at least substantially zero, ideally zero (short-circuit), between the adaption walls at the level of the coupling ends of two coupled guide channels so as to improve the transmission of an electromagnetic wave by reducing energy losses in particular. In particular, the input impedance has to be low in order to obtain a virtual perfect electrical conductor between the two coupled guide channels. Consequently, the design of a transition device according to the present disclosure is simple and rapid.

The adaptation length l of each adaptation channel may be selected between $0.1\lambda$ and $0.5\lambda$, where $\lambda$ is the wavelength of the electromagnetic wave that propagates in this adaptation channel. Thus, the length of each adaptation channel is generally smaller than the dimensions of the superimposed layers of the waveguide according to the present disclosure. Furthermore, the length of each adaptation channel is smaller than the length of the dielectric interlayer.

A transition device of a multilayer waveguide according to the present disclosure allows reducing the transmission energy losses induced by the absence of electrical contact between two coupled guide channels. A transition device of a waveguide according to the present disclosure also allows reducing the reflection of the wave. In addition, the reduction in energy losses in the transmission of an electromagnetic wave is obtained over a wide frequency band (at least 30% of the central frequency of transmission of the electromagnetic wave).

Thus, the transition device according to the present disclosure allows obtaining a transmission of an electromagnetic wave between two coupled guide channels similar to a transmission which may be obtained between guide channels that would be in electrical contact. Hence, the transition device allows improving the transmission of electromagnetic waves between two coupled guide channels.

Improving the transmission of an electromagnetic wave between two coupled guide channels allows increasing considerably the number of guide channels and layers of the multilayer waveguide according to the present disclosure, and therefore facilitating the design of such multilayer waveguides and antennas comprising such multilayer waveguides.

Furthermore, the transition device has the advantage of having a structure which is simple to manufacture and inexpensive.

Moreover, it has been observed that a transition device of a waveguide according to the present disclosure is tolerant to manufacturing defects, a shift in the alignment of the coupled guide channels, and therefore of their adaptation walls, resulting in very low energy losses in comparison with a perfect alignment.

More particularly, the coupled guide channels extend in two different superimposed layers of the multilayer electromagnetic waveguide. Furthermore, the dielectric interlayer extends between two superimposed layers of the multilayer electromagnetic waveguide, no electrically-conductive element enabling an electrical connection between these two superimposed layers being present between the latter. Thus, only one dielectric interlayer is present between said superimposed layers and between the adaptation walls of the transition device. Hence, said superimposed layers are electrically insulated from each other The longitudinal direction of each adaptation channel is secant with the transmission direction, that is to say in particular that it is not parallel to the latter. The angle formed between this longitudinal direction of an adaptation channel and the transmission direction may be arbitrary but is preferably larger than 45°, in particular larger than 60°, more particularly comprised between 80° and 90°, including these values. Thus, in some forms, the longitudinal direction of each adaptation channel is orthogonal to the transmission direction. Thus, the adaptation walls of each adaptation channel are orthogonal to the guide walls of the guide channels.

In some forms of a waveguide according to the present disclosure, at least one transition device comprises one single adaptation channel extending on only one side from the coupled guide channels, according to a longitudinal direction secant to the transmission direction.

Alternatively or in combination, at least one transition device comprises at least two adaptation channels extending opposite to each other from the coupled guide channels, each adaptation channel extending according to a longitudinal direction secant to the transmission direction.

Alternatively or in combination, at least one transition device comprises at least four adaptation channels extending opposite to each other in pairs from the coupled guide channels, distributed at 90° around the coupled guide channels, each adaptation channel extending according to a longitudinal direction secant to the transmission direction.

A waveguide according to the present disclosure comprises several superimposed layers to form channels for guiding an electromagnetic wave.

In particular, in some forms, a waveguide according to the present disclosure is constituted by at least one—in particular by only one—plurality of stacked layers superimposed on each other and fastened to each other in pairs. At least two layers comprise at least one aperture, the different apertures formed throughout the different layers being arranged so as to form guide channels within the waveguide. Thus, an electromagnetic wave may thus be guided in the different apertures of each layer of the multilayer waveguide. In particular, a waveguide according to the present disclosure comprises at least one transition device between two coupled guide channels extending respectively throughout the thickness of two superimposed layers by a dielectric interlayer. The faces of the adjacent layers define a plane, called main plane, the direction across the thickness of the different layers being orthogonal to this main plane. Preferably, the transmission direction is at least substantially orthogonal to the main plane of each layer. However, there is nothing to prevent from having the transmission direction being non-orthogonal, more or less inclined with respect to the normal to the main plane of each layer, that is to say with respect to the direction of the thickness of each layer.

In some of these forms, a waveguide according to the present disclosure is formed by a plurality of plates for manufacturing a printed circuit board (PCB) stacked on each other by adhesive films. Each plate for manufacturing a printed circuit board comprises at least one dielectric material thickness, called substrate, and at least one electrically-conductive material thickness applied over at least one main face of the substrate. Each adhesive film interposed between two plates for manufacturing printed circuit boards constitutes a dielectric interlayer. The guide channels may be formed at least partially by an etching/deposition method of plates for manufacturing printed circuit boards. In particular, such an etching/deposition method allows making holes throughout the thickness of each plate or the electrically-conductive material thickness of each plate and/or depositing an electrically-conductive material, such as copper, to form tracks at the surface of the substrate or vias or vias' bores (a via is a connection made of an electrically-conductive material, in general in the form of a hollow or solid revolution cylinder, formed in or throughout the thickness of at least one dielectric solid material layer, cf. for example «Electromagnetics for High-Speed Analog and Digital Communication Circuits» of Ali M. Niknejad, published in 2007). Other variants may be considered, for example by superimposition of dielectric material layers (called substrate), fastened to each other but away from each other, an air layer being formed between each substrate layer, this air layer constituting a dielectric interlayer. This air layer may be unintended, due to manufacturing errors, in particular during the manufacture of hollow waveguides. This air layer results in electromagnetic waves transmission losses between two guide channels in the absence of a transition device according to the present disclosure. Hence, the transition device according to the present disclosure allows reducing the electromagnetic waves transmission losses between two coupled guide channels related to this air layer.

In some forms, a waveguide according to the present disclosure comprises several stackings of layers superimposed on each other, the different stackings being contiguous in pairs side-by-side, at least one transition device being formed between two contiguous stackings, that is to say between two coupled guide channels extending respectively in each stacking and parallel to the main plane of the layers of each stacking. In these forms, the transmission direction is therefore parallel to the main plane of the layers of each stacking, and the longitudinal direction of the adaptation channels may be orthogonal to the main plane of the layers of each stacking. Herein again, each stacking may in particular be formed by a plurality of plates for manufacturing printed circuit boards stacked on each other by adhesive films. Other variants of each stacking may be considered for example as indicated hereinabove.

In some forms according to the present disclosure, each adaptation wall of at least one adaptation channel is formed by a metallic layer. For example, a metallic layer may consist of a metallic blade or a plurality of separate and contiguous electrically-conductive vias parallel to each other. Thus, an adaptation channel comprises two adaptation walls, each adaptation wall being formed by a metallic blade. In some variants, an adaptation channel comprises two adaptation walls, each adaptation wall being formed by a plurality of electrically-conductive vias. In some other variants, an adaptation channel comprises a first adaptation wall formed by a metallic blade and a second wall formed by a plurality of electrically-conductive vias.

In particular, it is known that such a plurality of contiguous vias is, with regards to the transmission of the electromagnetic wave, equivalent to a continuous metallic blade, as long as the distance separating two adjacent vias is smaller than a predetermined distance depending on the wavelength of the electromagnetic wave. The making of a waveguide wall by contiguous vias has the advantage of enabling a collective manufacture by rapid and economical etching/deposition methods, using conventional machines already widely used on an industrial scale.

In some forms of the present disclosure, each via of an adaptation wall extends along said dielectric interlayer from a coupling end of a coupled guide channel according to the longitudinal direction of the adaptation channel.

Furthermore, in some other forms, each via of an adaptation wall extends orthogonally to the longitudinal direction of the adaptation channel and to the transmission direction.

In some forms of a waveguide according to the present disclosure, the dielectric interlayer is interposed between two of said superimposed layers in which extend the coupled guide channels. Furthermore, each adaptation wall extends between the dielectric interlayer and one of the preceding superimposed layers.

In particular, in some of these forms of a waveguide according to the present disclosure, the dielectric interlayer is interposed between two dielectric substrate layers in which extend the coupled guide channels. Furthermore, each adaptation wall extends between the dielectric interlayer and one of the dielectric substrate layers.

In some forms, each layer of a multilayer waveguide, in which extends a coupled guide channel, comprises a thickness of a solid and rigid dielectric material, called substrate, common to the different layers of the waveguide superimposed on each other in pairs by a dielectric interlayer which may, or not, be formed by the same substrate. For example, such guide channels are described in the publication «A Multilayer LTCC Solution for Integrating 5G Access Point Antenna Modules», F. Foglia Manzillo et al., in IEEE Transactions on Microwave Theory and Techniques, vol. 64, no. 7, pp. 2272-2283, July 2016.

In particular, the dielectric interlayer is disposed between faces, called coupling faces, of two dielectric substrate layers. Furthermore, the coupling ends of the guide channels open onto these coupling faces. Thus, the adaptation walls of each adaptation channel are placed between a coupling face of one of the dielectric substrate layers comprising a coupled guide channel and the dielectric interlayer of the transition device. In these forms, the adaptation channels are parallel to the assembly faces of the dielectric substrate layers.

Thus, a transition device of a waveguide according to the present disclosure allows providing an electromagnetic wave transmission between coupled guide channels of several superimposed layers by reducing energy losses.

Moreover, each coupled guide channel is delimited by at least two electrically-conductive walls, called guide walls, spaced from each other. Thus, when a coupled guide channel is delimited only by two guide walls, this guide channel is called «parallel-plate waveguide». Thus, it is possible to obtain a quasi-TEM electromagnetic transverse propagation mode in such coupled guide channels.

In some forms, each coupled guide channel is delimited by guide walls parallel in pairs and arranged to form a polygonal—in particular rectangular—cross-section of the coupled guide channel. Such a guide channel may be qualified as «rectangular waveguide» (often referred to by the acronym RW). Thus, it is possible to obtain a $TE_{10}$ electrical transverse propagation mode in such a guide channel. In some forms of a multilayer waveguide having coupled guide channels forming rectangular waveguides, the adaptation walls of the transition device may consist of peripheral walls of the coupling end of each guide channel.

For example, one adaptation wall may be formed by a plurality of contiguous electrically-conductive vias parallel to each other.

Thus, in some forms, each guide wall of at least one coupled guide channel is a metallic plate.

In some variants, each guide wall of at least one coupled guide channel is formed by a plurality of electrically-conductive vias.

In some other variants, at least one guide wall of at least one coupled guide channel is formed by a metallic plate and at least one other guide wall of this coupled guide channel is formed by a plurality of electrically-conductive vias.

A guide channel whose guide walls are formed by contiguous vias allows guiding an electromagnetic wave in a similar manner as a guide channel whose guide walls are formed by metallic plates. The orientation of the vias is the same on two parallel guide walls of a coupled guide channel. In particular, when a guide channel is a rectangular waveguide, the vias are oriented in the same direction as that of a field $\vec{E}$ relating to the electromagnetic mode that is desired to prevail in the guide channel. Furthermore, when a guide channel is a parallel-plate waveguide, the vias are oriented orthogonally to the direction of a field $\vec{E}$ relating to the electromagnetic mode that is desired to prevail in the guide channel.

In particular, in some forms, the vias of at least one guide wall of at least one guide channel extend parallel to the transmission direction.

Moreover, preferably, the vias of the guide walls of two coupled guide channels are aligned with respect to each other which allows improving the transmission of an electromagnetic wave between these coupled guide channels.

Furthermore, in some other forms, the vias of at least one guide wall of at least one guide channel extend orthogonally to the transmission direction.

The present disclosure also relates to an antenna comprising at least one waveguide according to the present disclosure.

In particular, an antenna according to the present disclosure may consist of an antenna having a structure of the type called CTS, acronym of «Continuous Transverse Stub» as described for example by U.S. Pat. No. 6,101,705.

The present disclosure also relates to a method for manufacturing a multilayer electromagnetic waveguide comprising several superimposed layers forming channels for guiding an electromagnetic wave, and at least one transition device comprising at least one dielectric interlayer between two guide channels, called coupled guide channels, extending according to a direction of transmission of an electromagnetic wave between these coupled guide channels via the transition device, characterized in that the transition device is manufactured so that:

each transition device comprises at least one adaptation channel extending from the coupled guide channels, according to a longitudinal direction secant to the transmission direction, each adaptation channel is delimited by at least two electrically-conductive walls, called adaptation walls, spaced from each other by said dielectric interlayer of said transition device, each adaptation wall extending according to the longitudinal direction along said dielectric interlayer from one end, called coupling end, of a coupled guide channel, and at least one adaptation wall extending according to the longitudinal direction over a length selected so as to obtain an impedance, called input impedance, at least substantially zero between the adaptation walls of this adaptation channel at the level of the coupling ends of the coupled guide channels to optimize the transmission of an electromagnetic wave between the two coupled guide channels.

The present disclosure also concerns a multilayer waveguide comprising a transition device with two guide channels of the multilayer waveguide, a method for manufacturing such a multilayer waveguide and an antenna comprising such a multilayer waveguide characterized in combination with all or part of the features mentioned hereinabove or hereinafter.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 15:
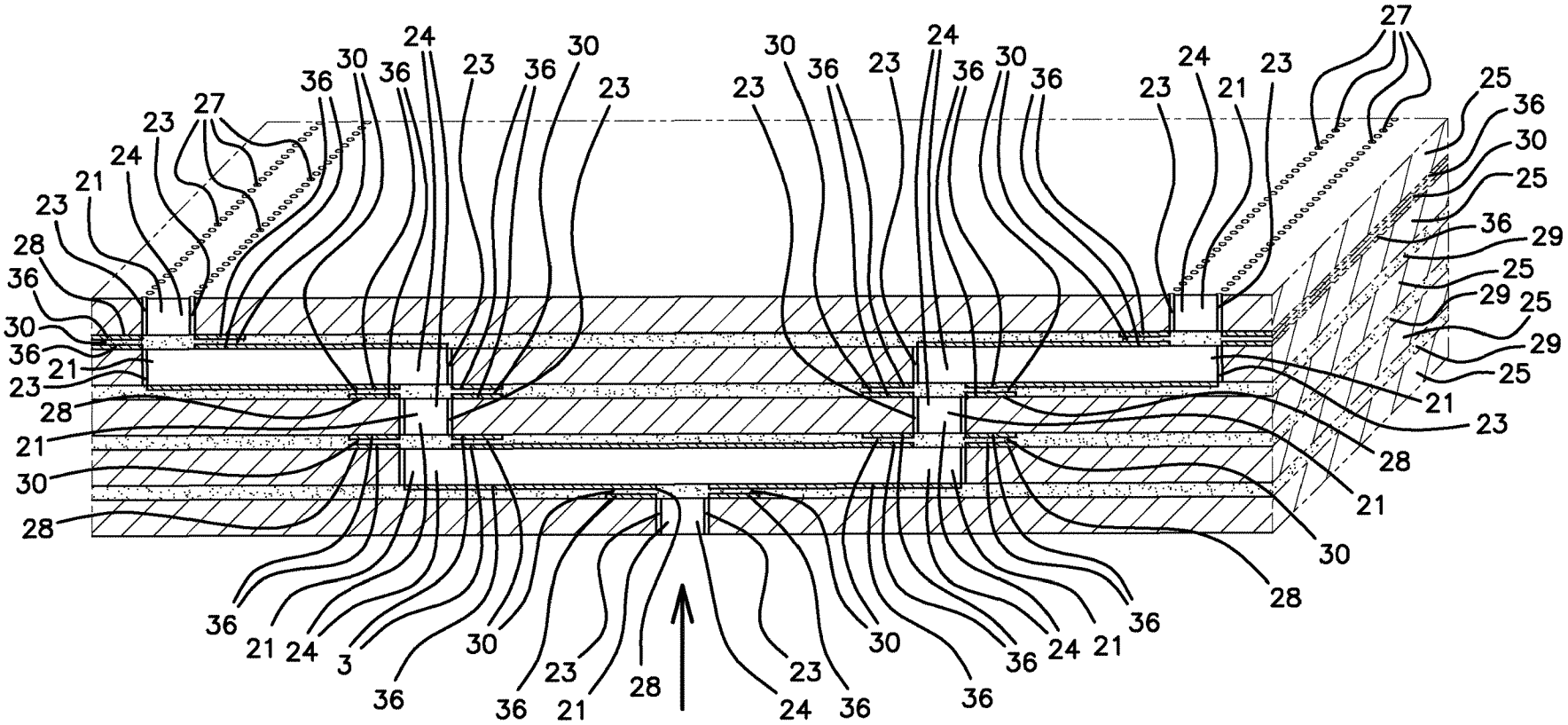
Figure 16:
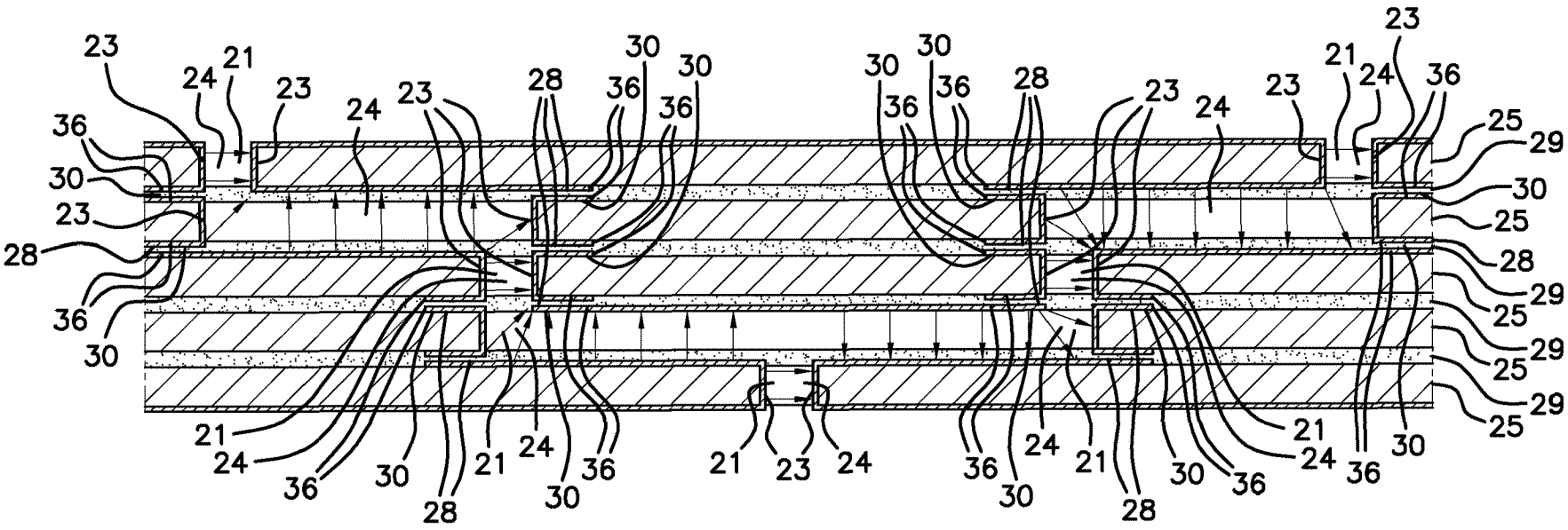

FIG. 15 is a schematic sectional view across the thickness of an example of a portion of an antenna structure according to the present disclosure with radiating slots; and FIG. 16 is a schematic longitudinal sectional view of a multilayer waveguide according to another form according to the present disclosure comprising five substrate layers forming a multilayer supply network called candlestick network.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

A multilayer waveguide 20 according to the present disclosure as represented in FIGS. 1 to 6 and 8 comprises at least two guide channels 21.

Each guide channel 21 extends longitudinally according to a transmission direction 22 and is transversely delimited by at least two electrically-conductive walls, called guide walls 23, spaced from each other by a dielectric material 24. Thus, each guide channel 21 allows guiding an electromagnetic wave between its guide walls 23. The guide channels 21 have the same characteristic impedance $Z_{C1}$.

Moreover, the guide walls 23 transversely delimiting a guide channel 21 are symmetrical in pairs with respect to a plane, called transmission plane, parallel to these guide walls 23 and equidistant from the guide walls 23, this transmission plane being a midplane of the guide channel 21.

The dielectric material 24 interposed between two guide walls 23 of a guide channel 21 may consist of air or else any other appropriate dielectric solid material. For example, the dielectric element 24 has a relative dielectric permittivity coefficient comprised between 1 and 10, nevertheless there is nothing to prevent from having such a coefficient higher than 10.

In some forms, the guide channels 21 of the multilayer waveguide 20 are integrated into layers 25 of the same solid and rigid dielectric material, called substrate, of the multilayer waveguide 20, superimposed in pairs. The used substrate is selected according to the applications of the multilayer waveguide. In particular, the substrate generally consists of an organic substrate with a low relative dielectric permittivity, that is to say lower than 4. For example, the substrate may consist of a composite material formed of polytetrafluoroethylene and glass fibers such as RT/Duroid® 5880 in order to transmit high-frequency electromagnetic waves. The substrate may also consist of a dielectric foam whose relative dielectric permittivity is close to that of air ($\varepsilon_r$=1).

In particular, in some of these forms, each layer 25 is a plate for manufacturing a printed circuit board (PCB). Each layer 25 then comprises a dielectric material thickness, called substrate, and an electrically-conductive material thickness applied over its two main faces of the substrate.

Each substrate layer 25 has at least one outer face, called coupling face, so that, when the substrate layers 25 are superimposed, a coupling face of a substrate layer 25 faces a coupling face of another superimposed layer. Preferably, the coupling faces of the substrate layers 25 are planar and parallel to each other. Thus, the layers of the waveguide can be superimposed more easily.

Figure 1:
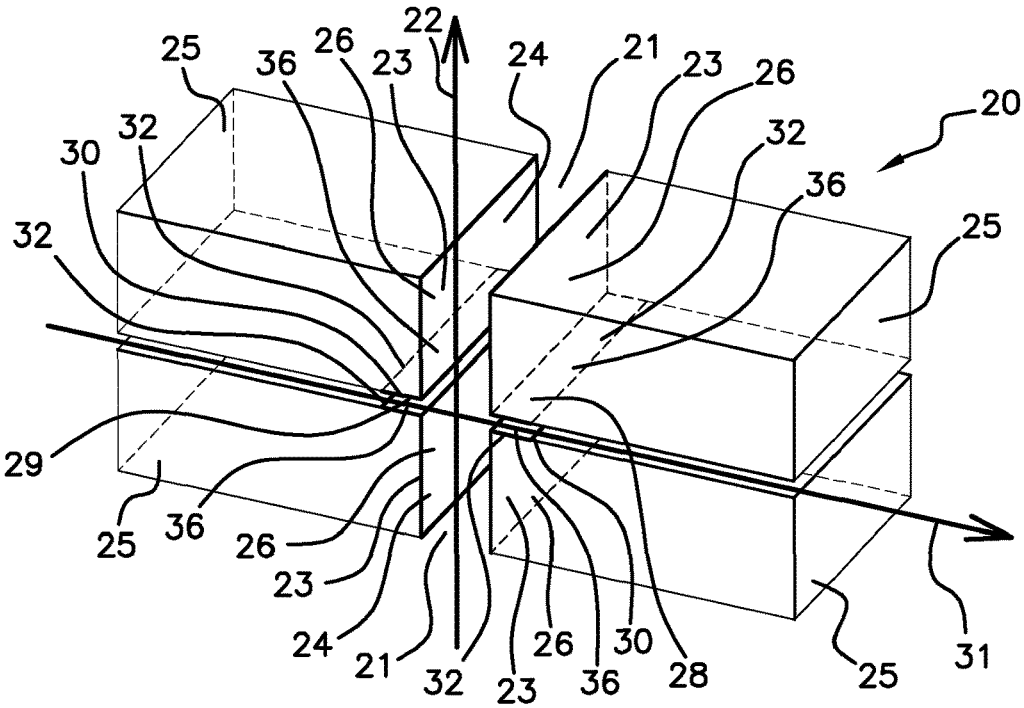
FIGS. 1 to 5 are schematic perspective views of multilayer waveguides according to five forms of the present disclosure.

A multilayer waveguide according to the forms of the present disclosure represented in FIG. 1, comprises two guide channels 21, called coupled guide channels 21, extending axially but separated from each other so as to have an absence of electrical contact between these two guide channels 21. One end, called coupling end, of a coupled guide channel 21 thus faces a coupling end of another coupled guide channel 21 so that an electromagnetic wave could be transmitted between these two coupled guide channels 21.

In particular, the two coupled guide channels 21 are integrated respectively into two substrate layers 25 separated away from each other. An electromagnetic wave can then be transmitted between these two substrate layers 25 of the multilayer waveguide 20. Thus, the substrate layers 25 of the multilayer waveguide 20 are superimposed so that the coupling ends of the coupled guide channels 21 of two superimposed substrate layers 25 face each other but are away from each other.

Preferably, the transmission direction 22 is orthogonal to the coupling face of each substrate layer 25.

Furthermore, each coupled guide channel 21 is transversely delimited by two guide walls 23. Thus, the guide channel 21 is a parallel-plate waveguide. In particular, each coupled guide channel 21 is delimited by two metallic plates parallel to each other and with the same dimensions.

More particularly, the guide walls 23 delimiting the same side of two coupled guide channels 21 are placed on the same plane so that the two coupled guide channels 21 are perfectly aligned.

The multilayer waveguide 20 comprises, for each pair of coupled guide channels 21, a transition device 28 of the two coupled guide channels 21. This transition device 28 comprises a dielectric interlayer 29 disposed between the two substrate layers 25 comprising the coupled guide channels 21.

In particular, this dielectric interlayer 29 may consist of an adhesive film or a glue layer allowing assembling the substrate layers 25 to each other. For example, the adhesive film may be constituted by a tissue pre-impregnated with resin. For example, the dielectric interlayer 29 has a relative dielectric permittivity coefficient comprised between 2 and 4, more particularly in the range of 2.5. The dielectric interlayer 29 has a smaller thickness than the thickness of each of the two substrate layers 25 connected thereby. In particular, the thickness of the dielectric layer 29 is for example smaller than the wavelength $\lambda$ of the electromagnetic wave that propagates in this same dielectric layer 29. For example, in order to transmit a wave between two coupled guide channels at a 30 GHz frequency, the dielectric interlayer 29 has a thickness smaller than $\lambda/10$, preferably smaller than $\lambda/100$.

Alternatively, the dielectric interlayer 29 may be formed by an air layer. This air layer may be unintended, due to manufacturing errors, in particular during the manufacture of hollow waveguides. The substrate layers 25 are then assembled to each other by a mechanical assembly device such as screws or else by pressing for example.

The transition device 28 also comprises at least one adaptation channel 30 extending from the coupled guide channels, each adaptation channel 30 extending according to a longitudinal direction secant to the transmission direction, between the two layers 25 comprising the two coupled guide channels 21. Furthermore, each adaptation channel 30 is delimited by two electrically-conductive walls, called adaptation walls 36, spaced from each other by the dielectric interlayer 29. Each adaptation wall 36 extends between a substrate layer 25 comprising a coupled guide channel 21 and the dielectric interlayer 29. Thus, in some forms of a waveguide according to the present disclosure, at least one transition device comprises one single adaptation channel extending at only one side from the coupled guide channels, according to a longitudinal direction secant to the transmission direction.

Alternatively or in combination, as represented in FIGS. 1 to 6, at least one transition device comprises at least two adaptation channels extending opposite to each other from the coupled guide channels, each adaptation channel extending according to a longitudinal direction secant to the transmission direction.

Each adaptation channel 30 extends according to a longitudinal direction 31, secant to the transmission direction 22, over a predetermined length, called adaptation length l, from the guide walls 23 of the coupled guide channels 21 at the level of the opposing coupling ends of the coupled guide channels 21, and away from these coupled guide channels 21.

In particular, a first adaptation channel 30 of the transition device 28 of two coupled guide channels 21 has a first adaptation wall 36 extending orthogonally to the transmission direction 22 from a first guide wall 23 of a first coupled guide channel 21 at the level of its coupling end. The first adaptation channel 30 also comprises a second adaptation wall 36 extending orthogonally to the transmission direction 22 from a first guide wall 23 of a second coupled guide channel 21 at the level of its coupling end, the first guide wall 23 of the first guide channel 21 and the first guide wall 23 of the second guide channel 21 being placed on the same side of the transmission plane.

A second adaptation channel 30 of the transition device 28 has a first adaptation wall 36 extending orthogonally to the transmission direction 22 from a second guide wall 23 of the first guide channel 21 at the level of its coupling end. The first adaptation channel 30 also comprises a second adaptation wall 36 extending orthogonally to the transmission direction 22 from a second guide wall 23 of the second guide channel 21 at the level of its coupling end.

Each adaptation wall 36 may be formed by an electrically-conductive blade, called adaptation blade 32. Each adaptation blade 32 extends over the adaptation length l from a coupling end of an adaptation guide channel 21 and has a width equal to the width of this coupling end of this guide channel 21. Preferably, an adaptation conductive blade 32 is orthogonal to the transmission direction 22.

The adaptation blades 32 may be disposed against the dielectric substrate layers 25.

Figure 2:
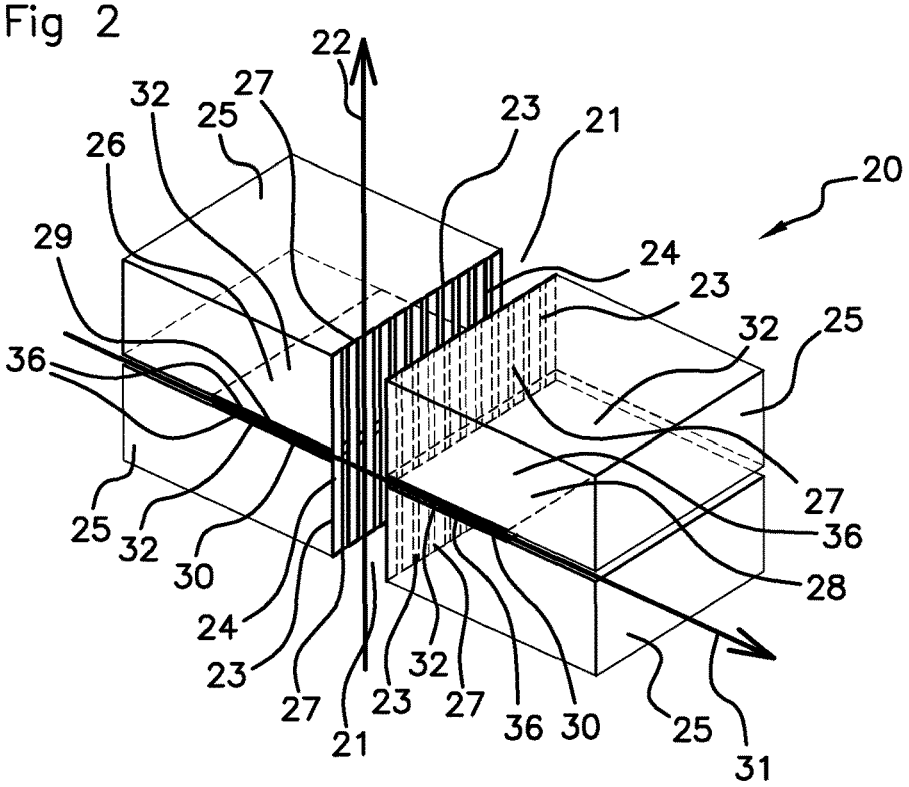
Figure 3:
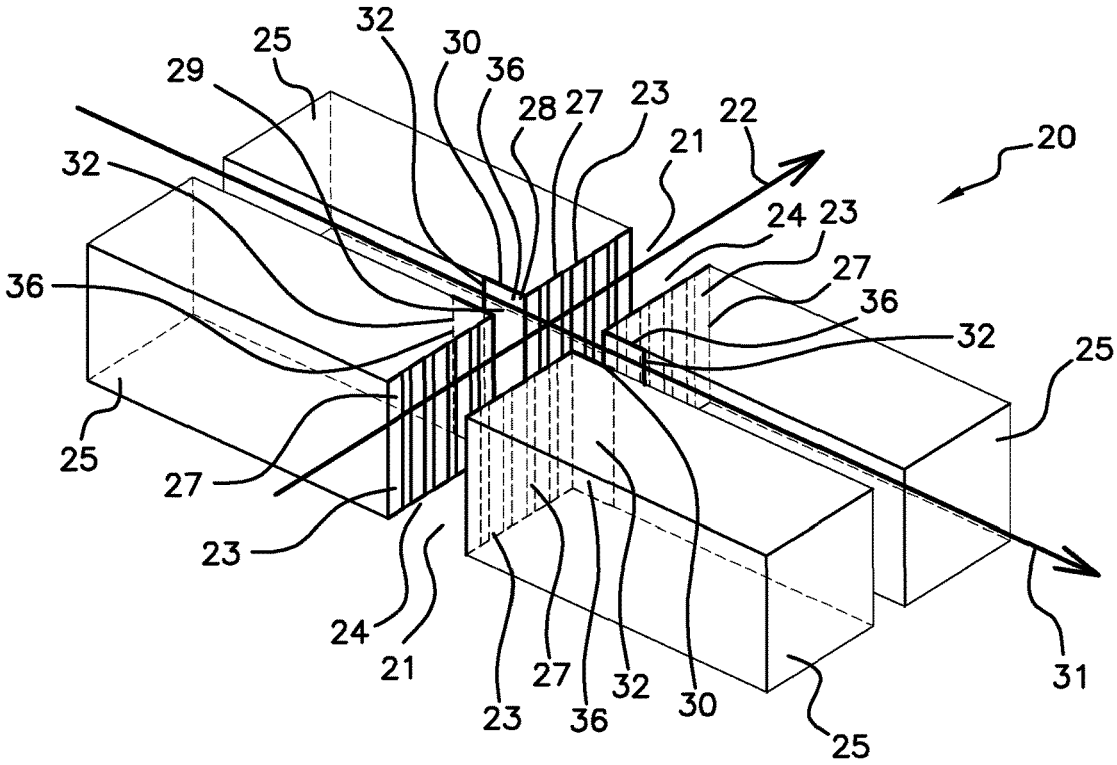

In one variant represented in FIG. 2, a coupled guide channel 21 is delimited by two guide walls 23, each guide wall 23 being formed by a row of contiguous vias 27 so as to form a parallel-plate waveguide. Preferably, the vias 27 of the two guide walls 23 are symmetrical to each other with respect to the transmission plane of the guide channel 21. The vias 27 may be oriented according to the transmission direction 22 as represented in FIG. 2 or on the contrary orthogonally to the transmission direction 22 as represented in FIG. 3 depending on the electromagnetic mode that is desired to prevail in the guide channel. The vias 27 of a guide channel 21 are generally integrated into a dielectric substrate layer 25 and throughout the thickness thereof. In particular, when a guide channel is a parallel-plate waveguide, the vias are oriented orthogonally to the direction of a field $\vec{E}$ relating to the electromagnetic mode that is desired to prevail in the guide channel.

The contiguous vias 27 forming a guide wall 23 are spaced from each other by a given distance, for example close to the diameter of the vias, so that a row of vias is similar to a metallic wall with respect to an electromagnetic wave transmission. In particular, the arrangement of the vias 27 of a guide wall 23 is described for example by J. Hirokawa and M. Ando, "Single-layer feed waveguide consisting of posts for plane TEM wave excitation in parallel plates," IEEE Trans. Antennas Propag., vol. 46, no. 5, pp. 625-630, May 1998 and by D. Deslandes, K. Wu, "Accurate modeling, wave mechanisms, and design considerations of a substrate integrated waveguide". IEEE Trans. on Microwave Theory and Techniques, 2006, vol. 54, no. 6, pp. 2516-2526, or else by F. Foglia Manzillo et al., "A Multilayer LTCC Solution for Integrating 5G Access Point Antenna Modules," in IEEE Transactions on Microwave Theory and Techniques, 20 vol. 64, no. 7, pp. 2272-2283, July 2016.

Figure 4:
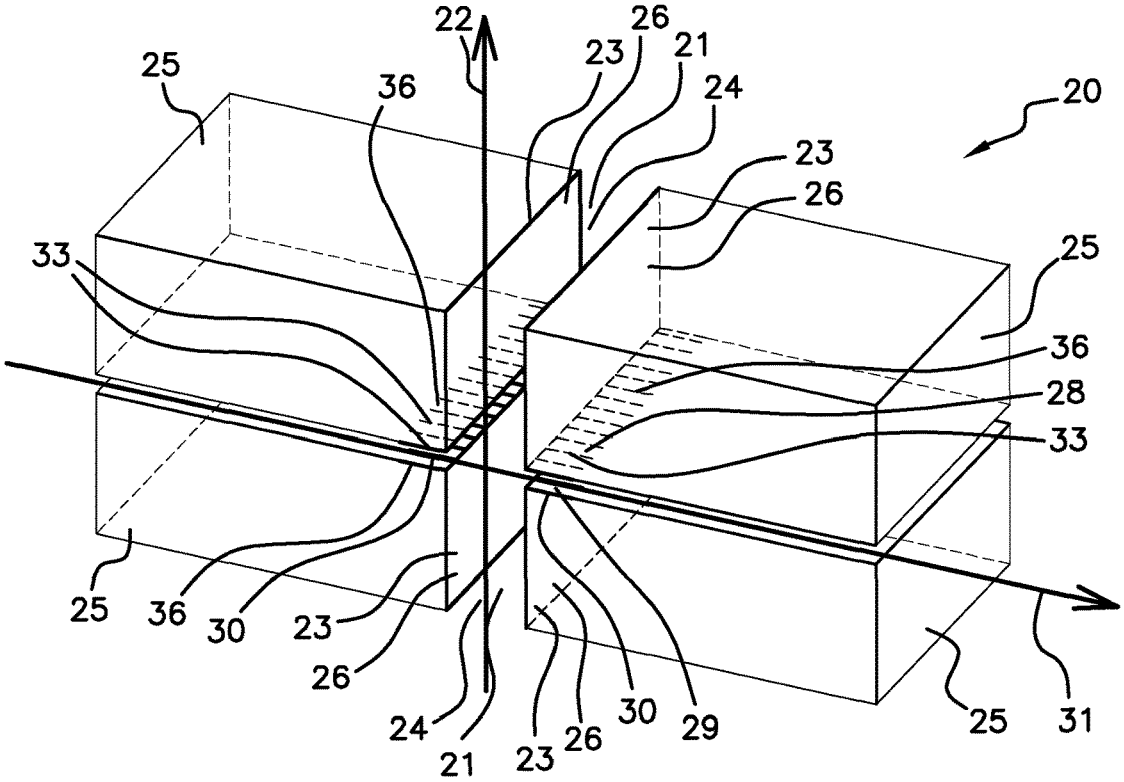

In one variant represented in FIG. 4, the guide channels 21 are delimited by two metallic plates 26 parallel to each other and each adaptation wall 36 of each adaptation channel 30 is formed by a row of contiguous vias 33 parallel to each other and extending according to the longitudinal direction 31 of the adaptation channel 30. More particularly, the vias 33 extend along said dielectric interlayer 29 from a coupling end of a coupled guide channel 21.

Figure 5:
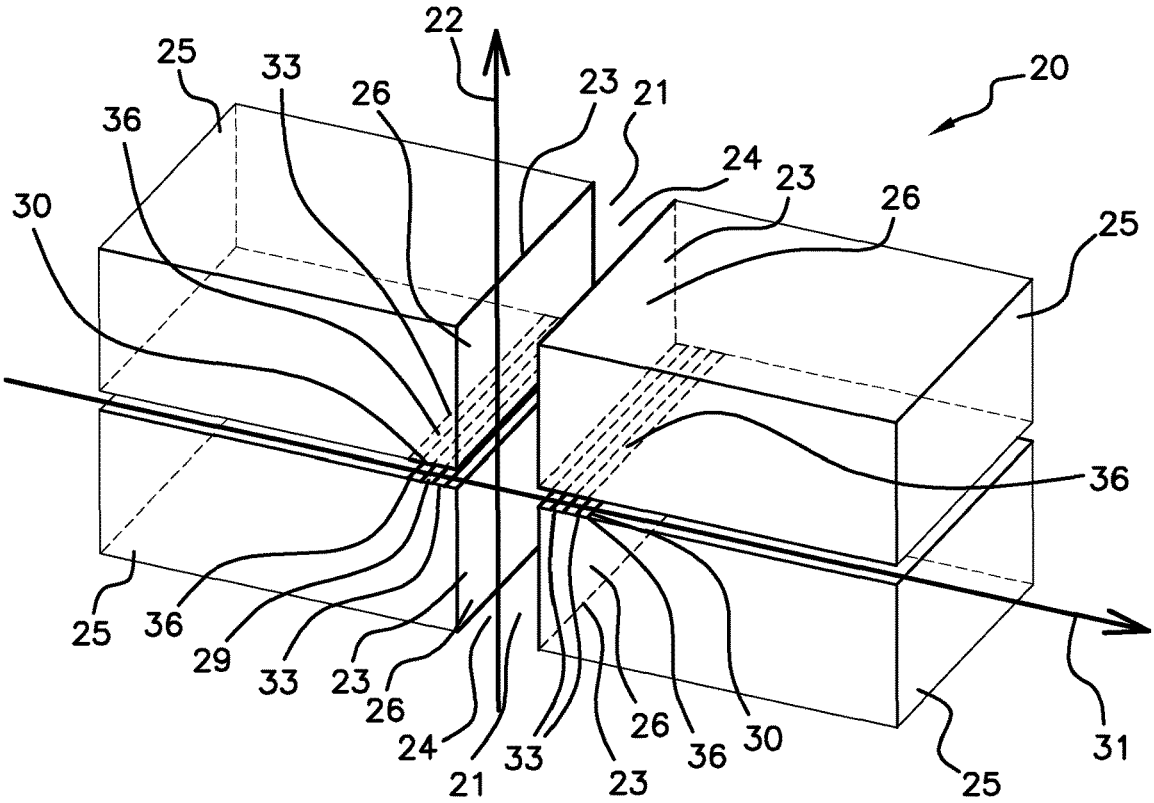

In one variant represented in FIG. 5, the guide channels 21 are delimited by two metallic plates 26 parallel to each other and each adaptation wall 36 of each adaptation channel 30 is formed by a row of contiguous vias 33 parallel to each other and extending orthogonally to the longitudinal direction 31 of the adaptation channel 30 and to the transmission direction 22.

Figure 7:
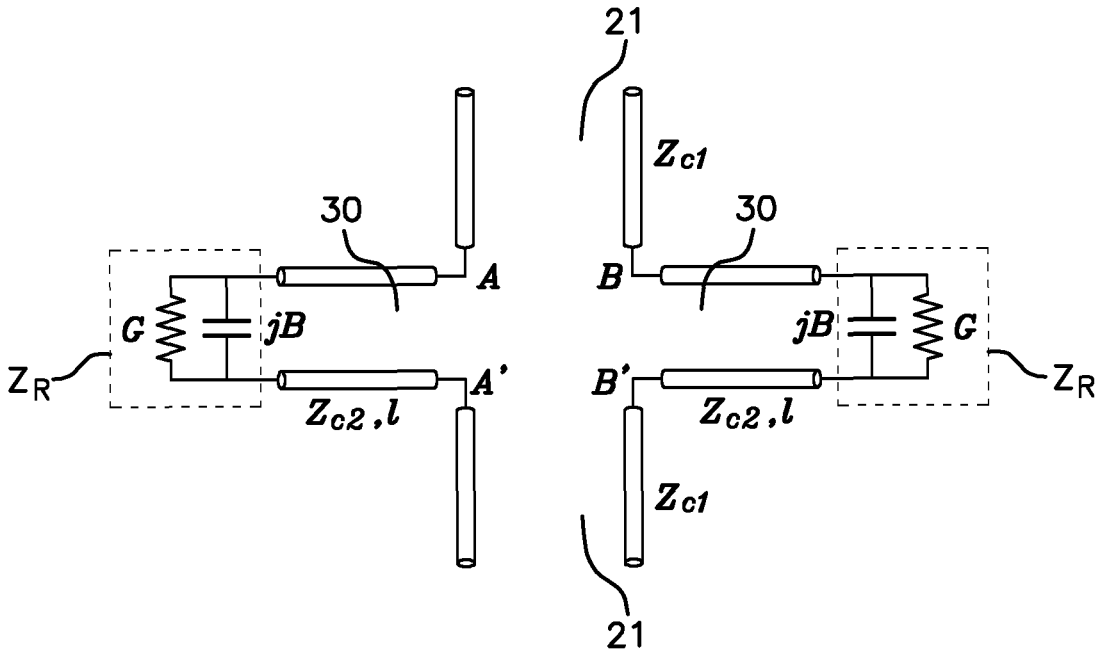
FIG. 7 is a first diagram of the equivalent circuit of a multilayer waveguide according to the present disclosure comprising two guide channels and an adaptation device.

More particularly, FIG. 7 represents an equivalent diagram of a multilayer waveguide according to the present disclosure having two guide channels coupled by two adaptation channels.

The formulas given hereinafter are valid for multilayer waveguides having two parallel-plate waveguide type coupled guide channels and when the thickness of the dielectric interlayer is smaller than the wavelength of the electromagnetic waves in the guide channels.

Each adaptation channel 30 has a terminal load with an impedance $Z_R$, at its end according to said longitudinal direction opposite to the coupled guide channels 21, which has a finite and non-zero value, representative of the phenomena of fringing fields and of radiation effects occurring at the ends of each adaptation channel opposite to the guide channels. This terminal load is equivalent to a resistance in parallel with a capacitor at this end of the adaptation channel. This terminal load implies that each adaptation channel 30 does not terminate neither in a short-circuit nor in an open circuit.

When the relative permittivity $\varepsilon_{r1}$ of the layers 25 and the relative permittivity $\varepsilon_{r2}$ of the dielectric interlayer 29 are equal to 1, the impedance $Z_R$ of the terminal load may be given by the formula $$Z_R = \frac{1}{G + jB}, \text{ where } G = \frac{1}{Z_{c0}} \cdot \frac{\pi t}{2\lambda_0} \text{ and } B = \frac{1}{Z_{c0}} \cdot \frac{t}{\lambda_0} \ln\left(\frac{2e\lambda_0}{\gamma t}\right),$$

$$\text{with } Z_{c0} = \frac{\eta_0 t}{W},$$

$\eta_0$ being the impedance of an electromagnetic wave in vacuum, e~2.718, y~1.781, 20 the wavelength of the wave transmitted in vacuum, t being the thickness of the dielectric interlayer 29 and W being the width of the adaptation channel (see N. Marcuvitz, Waveguide Handbook, 3rd ed. New York, N.Y., USA: McGraw-Hill, 1951).

In order to optimize the transmission of the electromagnetic wave between two guide channels, the adaptation length l of each adaptation channel, and therefore of at least one adaptation wall, is selected so as to obtain an input impedance $Z_{AA}$, $Z_{BB}$ of this adaptation channel at least substantially zero. In particular, the input impedance $Z_{AA'}$, $Z_{BB'}$ of an adaptation channel is the impedance $Z_R$ of the terminal load brought at the input AA', BB' of the adaptation channel. The value of the impedance $Z_R$ of this terminal load depends in particular on the thickness and on the permittivity of the dielectric interlayer and on the permittivity of the superimposed layers forming guide channels.

The input impedance $Z_{AA'}$ and $Z_{BB'}$ of each adaptation channel may be defined by the formula $$Z_{AA'} = Z_{BB'} = Z_{c2} \frac{Z_R + jZ_{c2}\tan(\beta_2 l)}{Z_{c2} + jZ_R \tan(\beta_2, l)},$$

where $\varepsilon_{r2}$ is the characteristic impedance of each adaptation channel, with $$Z_{c2} = \frac{\eta_0 t}{\sqrt{\varepsilon_{r2}}\, W}, \ \beta_2 = \frac{2\pi}{\lambda_0}\sqrt{\varepsilon_{r2}},$$

and $\varepsilon_{r2}$ is the relative permittivity of the dielectric interlayer 29.

The input reflection coefficient $S_{11}$ of a first guide channel and the output reflection coefficient $S_{22}$ of a second guide channel coupled to the first guide channel may be obtained by the formula:

$$S_{11} = S_{22} = \frac{Z_{AA'}}{Z_{AA'} + Z_{c1}},$$

where $Z_{c1}$ is the characteristic impedance of each guide channel, with $$Z_{c1} = \frac{\eta_0 t}{\sqrt{\varepsilon_{r1}}\, W},$$

and $\varepsilon_{r1}$ is the relative permittivity of the layers 25.

The adjustment of the adaptation length l of each adaptation channel allows obtaining a low impedance, ideally zero (short-circuit), between the two coupled guide channels so as to improve the transmission of an electromagnetic wave by minimizing or reducing energy losses in particular. In order to obtain a zero input impedance between two parallel-plate waveguide type coupled guide channels, the adaptation length l of each adaptation channel may for example be selected between 0.1λ and 0.5λ, in particular between 0.2λ and 0.3λ. Consequently, the design of a transition device according to the present disclosure is simple and rapid.

The formulas given hereinabove are valid only for some forms of the present disclosure in which one single TEM mode propagates in the guide channels, the substrate layers 25 have the same relative permittivity $\varepsilon_{r1}$ and all waves propagate according to the direction of propagation.

Figure 8:
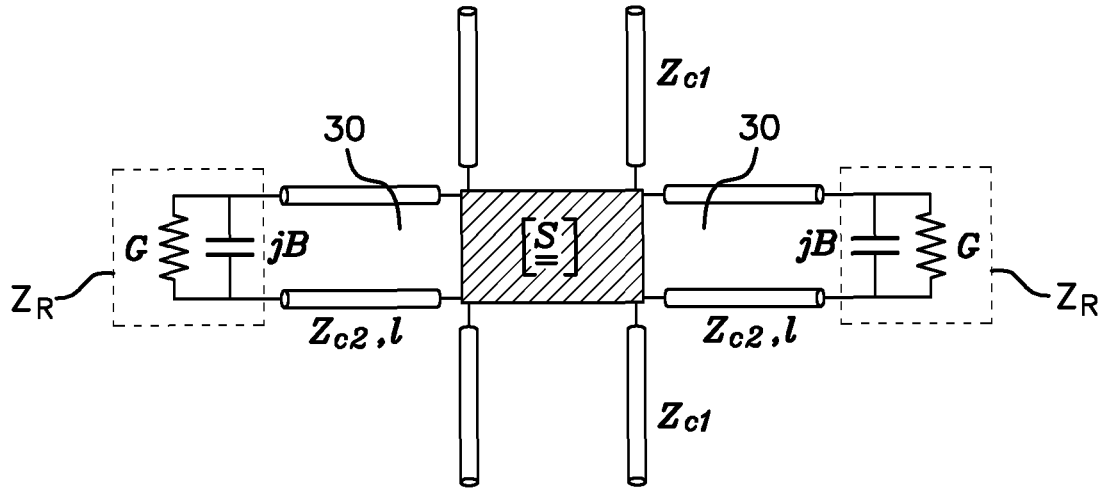
FIG. 8 is a second diagram of the equivalent circuit of a multilayer waveguide according to the present disclosure comprising two guide channels and an adaptation device.

FIG. 8 represents another equivalent diagram of a multilayer waveguide according to the present disclosure presenting two guide channels coupled by two adaptation channels 30. This equivalent diagram is valid for any thickness of the dielectric interlayer. Each adaptation channel 30 has a terminal load with an impedance $Z_R$, at its end according to said longitudinal direction opposite to the coupled guide channels 21, which has a finite and non-zero value, representative of the phenomena of fringing fields and of radiation effects occurring at the ends of each adaptation channel opposite to the guide channels. This terminal load is equivalent to a resistance in parallel with a capacitor at this end of the adaptation channel. Furthermore, the transition region between the adaptation channels and the guide channels is considered as a junction of four 4-port waveguides. The coefficients of a scattering matrix [S] associated to this junction may be obtained by digital simulation. Afterwards, the adaptation length l of each adaptation channel is determined from these coefficients.

The length of each adaptation channel 30 being easily calculable, a transition device 28 may be rapidly and simply designed.

Figure 9:
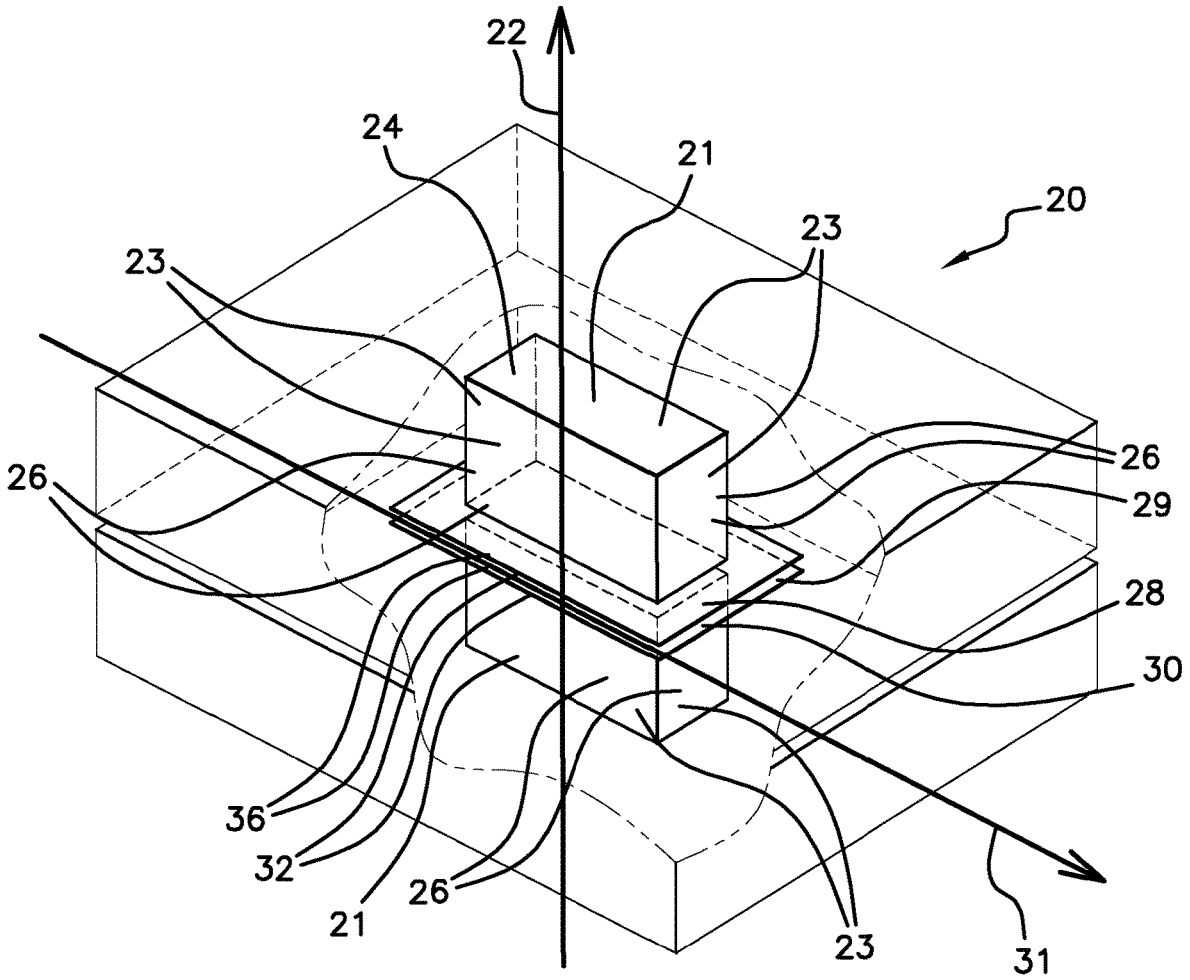
FIG. 9 is a schematic perspective view of a multilayer waveguide according to a sixth form of the present disclosure.

A multilayer waveguide according to the form represented in FIG. 9 comprises two parallelepipedic coupled guide channels 21. In particular, each coupled guide channel 21 is delimited by four guide walls 23 parallel in pairs and orthogonal in pairs. Thus, such guide channels 21 form rectangular waveguides. Each guide wall 23 is formed by a metallic plate 26. The transition device 28 then comprises four adaptation channels 30 between the two guide channels 21. The four adaptation channels 30 are orthogonal in pairs. In particular, each adaptation wall 36 of an adaptation channel 30 is formed by a metallic blade extending from a guide wall 23 of a coupled guide channel 21.

In one variant, when the coupled guide channels 21 form rectangular waveguides, the adaptation walls 36 of the transition device 28 may consist of peripheral walls of the coupling ends of the guide channels.

The adaptation length l of two adaptation walls 36 of a first adaptation channel may be different from that of two adaptation walls 36 of a second adaptation channel orthogonal to the first adaptation channel.

A transition device 28 according to the present disclosure allows improving the transmission of an electromagnetic wave between the coupled guide channels 21 by minimizing or reducing energy losses, as well as the reflection of the electromagnetic waves transmitted between two coupled guide channels 21. In particular, it allows obtaining in the two coupled guide channels 21 separated from each other a transmission of an electromagnetic wave similar to that which would be obtained with a continuous waveguide.

In all of the above-described examples, the frequency of the transmitted electromagnetic wave is 30 GHz. The layers of the compared multilayer waveguides are constituted by a substrate with a relative permittivity equal to 2.2. The results have been obtained by software simulation with an electromagnetic solver 3D simulation software, namely ANSYS HFSS®, commercialized by the company ANSYS, Inc., Canonsburg, Pa., USA. Other simulation software such as CST STUDIO SUITE®, commercialized by the company CST of America®, Inc., Framingham, Mass., USA, or COMSOL Multiphysics®, commercialized by the company COMSOL, Inc., Burlington, Mass., USA, or others, may be used.

COMPARATIVE EXAMPLE 1

With a multilayer waveguide not compliant with the present disclosure comprising two superimposed guide channels in electrical contact with each other, we obtain a transmission coefficient in the range of −0.01 dB and a reflection coefficient in the range of −70 dB.

COMPARATIVE EXAMPLE 2

With the case of a multilayer waveguide not compliant with the present disclosure comprising two superimposed guide channels not in electrical contact with each other, comprising a dielectric interlayer constituted by air with a 100 μm thickness between two layers of the multilayer waveguide 20 and comprising no transition device 28 according to the present disclosure, we obtain a transmission coefficient in the range of −4 dB and a reflection coefficient in the range of −5 dB.

EXAMPLE 3

With a multilayer waveguide according to the form represented in FIG. 1, comprising a dielectric interlayer 29 constituted by air with a 100 μm thickness between two layers of the multilayer waveguide 20, and adaptation blades 32 with an adaptation length l equal to 2 mm, we obtain a transmission coefficient in the range of −0.04 dB and a reflection coefficient in the range of −45 dB.

EXAMPLE 4

With a multilayer waveguide according to the form represented in FIG. 2 and for the same configuration as described for the multilayer waveguide according to the form of Example 3, we obtain a transmission coefficient in the range of −0.05 dB and a reflection coefficient in the range of −44 dB.

EXAMPLE 5

With a multilayer waveguide according to the form in FIG. 1 comprising a 36 μm adhesive film and with a 2.6 relative permittivity as a dielectric interlayer 29 of the transition device 28, as well as adaptation blades 32 with an adaptation length l equal to 2 mm, we obtain a transmission coefficient in the range of −0.01 dB and a reflection coefficient in the range of −66 dB.

EXAMPLE 6

Figure 6:
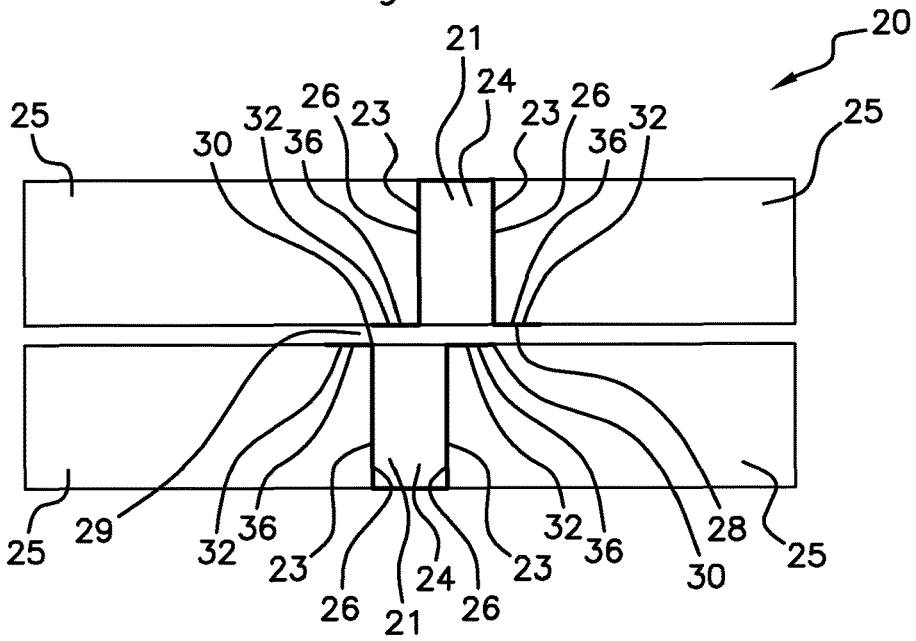
FIG. 6 is a schematic longitudinal sectional view of the multilayer waveguide of FIG. 1 whose guide channels are not perfectly aligned.

In the case of a multilayer waveguide as described in Example 3 and presenting, as represented in FIG. 6, a 0.2 mm misalignment between the two coupled guide channels 21, we obtain a transmission coefficient in the range of −0.05 dB and a reflection coefficient lower than −20 dB.

Hence, a transition device 28 according to the present disclosure is robust with regards to alignment defects of the coupled guide channels 21, which result in a low energy loss.

COMPARATIVE EXAMPLE 7

With a multilayer waveguide not compliant with the present disclosure comprising two superimposed guide channels with a rectangular section in electrical contact, each guide channel being delimited by four guide walls orthogonal in pairs, we obtain a transmission coefficient in the range of −0.03 dB and a reflection coefficient in the range of −85 dB.

COMPARATIVE EXAMPLE 8

With a multilayer waveguide not compliant with the present disclosure comprising two superimposed guide channels with a rectangular section which are not in electrical contact, comprising a dielectric interlayer constituted by air with a 100 μm thickness between the two guide channels and comprise no transition device 28 according to the present disclosure, each guide channel being delimited by four guide walls orthogonal in pairs, we obtain a transmission coefficient in the range of −3 dB and a reflection coefficient in the range of −5 dB.

EXAMPLE 9

In the case of a multilayer waveguide according to the form represented in FIG. 8 comprising a 100 μm thick air layer as a dielectric interlayer 29 between the two layers 25 of the multilayer waveguide 20, as well as adaptation blades 32 with adaptation lengths l equal to 2.6 mm for two first adaptation channels opposite to each other and 0.25 mm for two other adaptation channels opposite to each other and orthogonal to the two first adaptation channels, we obtain a transmission coefficient in the range of −0.04 dB and a reflection coefficient in the range of −55 dB.

FIGS. 10 to 13 present multilayer waveguides according to the form which may be used as a base block (assembly of coupled guide channels according to a T-like shape, in particular for power dividers, and coupled guide channels perpendicular to each other) for the design of antennas' multilayer waveguides with a more complex structure.

Figure 10:
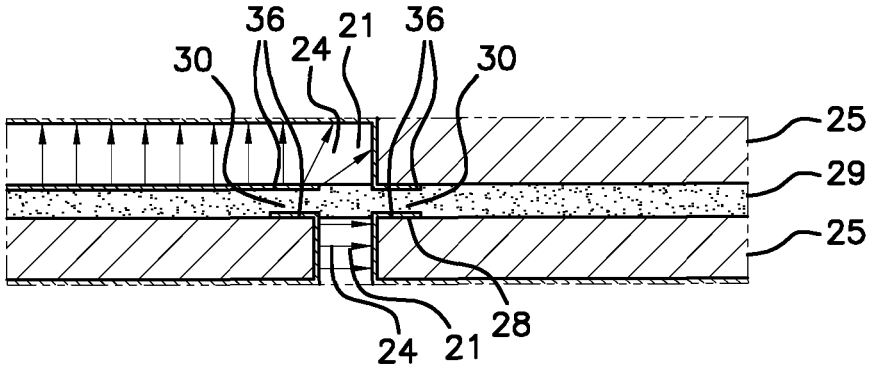
FIGS. 10 and 11 are schematic longitudinal sectional views of a multilayer waveguide according to different forms having two guide channels extending orthogonally with respect to each other.

In particular, FIG. 10 presents a multilayer waveguide of the present disclosure comprising two substrate layers 25 including a first substrate layer, called lower substrate layer, comprising a guide channel extending according to a transmission direction and a second substrate layer, called upper substrate layer, comprising a guide channel extending orthogonally to the transmission direction. The transition device 28 comprises two adaptation channels coupling the guide channel of the lower substrate layer to one end of the guide channel of the upper substrate layer. In particular, the adaptation wall of the transition device 28 placed in contact with the coupling face of the upper substrate layer extends along the guide channel of the upper substrate layer so as to delimit it and to enable the guidance of an electromagnetic wave in this guide channel.

Figure 11:
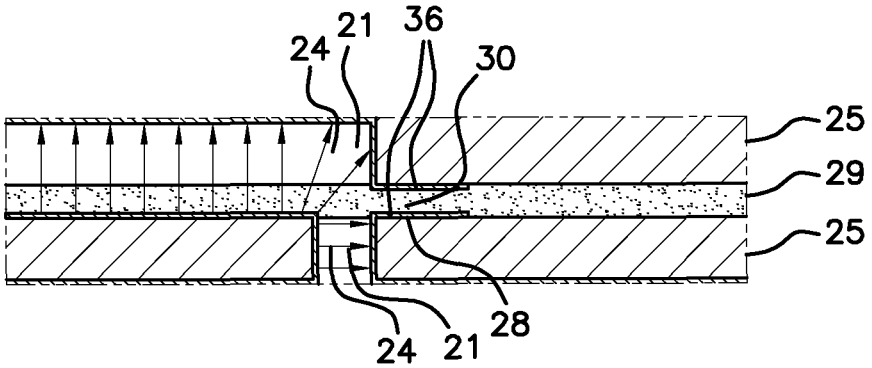

FIG. 11 presents a variant of the multilayer waveguide of FIG. 10, the transition device 28 comprising one single adaptation channel. In particular, the multilayer waveguide comprises two substrate layers 25. A first substrate layer, called lower substrate layer, comprises a guide channel extending according to a transmission direction. A second substrate layer, called upper substrate layer, comprises a guide channel extending orthogonally to the transmission direction. The unique adaptation channel, coupling the guide channel of the lower substrate layer at one end of the guide channel of the upper substrate layer, extends orthogonally to the transmission direction opposite to the guide channel of the upper substrate layer. The guide channel of the upper substrate layer is delimited by a metallized wall disposed between the lower substrate layer and the dielectric interlayer extending along the two substrate layers of the multilayer waveguide so as to enable the guidance of an electromagnetic wave in the guide channel of the upper substrate layer while providing the electrical contact with a guide wall of the guide channel of the lower substrate layer. Hence, the guide channel of the upper substrate layer partially comprises the dielectric interlayer.

Figure 12:
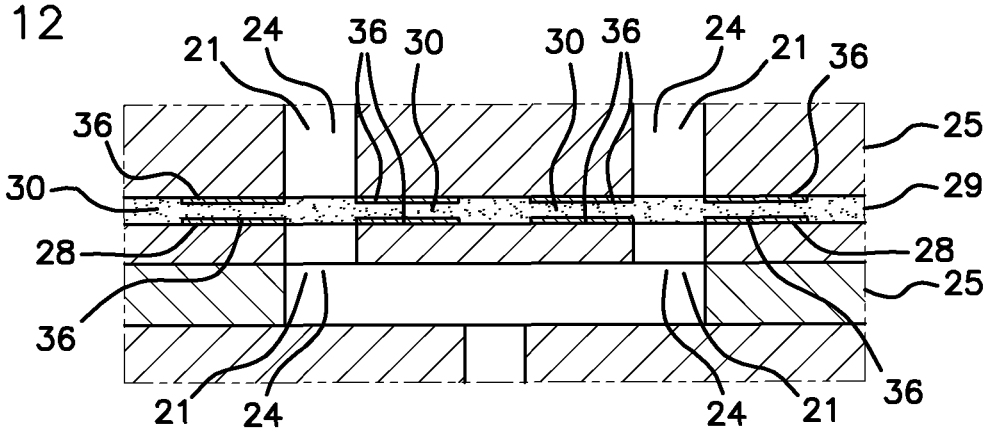
FIGS. 12 and 13 are schematic longitudinal sectional views of a multilayer waveguide according to different forms adapted to form a power divider.

FIG. 12 presents a multilayer waveguide according to the present disclosure allowing obtaining a power divider with one input and two outputs. In particular, the multilayer waveguide presents four substrate layers 25, a first substrate layer comprising a guide channel extending according to a transmission direction and being connected to a guide channel of a second substrate layer superimposed on the first layer, this last guide channel extending orthogonally to the transmission direction. A third substrate layer superimposed on the second substrate layer also comprises two coupled guide channels extending according to the transmission direction opening onto a coupling face of the third substrate layer. One of the guide channels of the third substrate layer being connected to one end of the guide channel of the second substrate layer, and the other guide channel being connected to another end of this guide channel. A fourth substrate layer 25 comprises two coupled guide channels extending according to the transmission direction, one of these guide channels being positioned opposite a guide channel of the third substrate layer and the other coupled guide channel of the fourth substrate layer facing the other guide channel of the third substrate layer. A first transition device 28 is respectively placed between a first coupled guide channel of the fourth substrate layer and the coupled guide channel facing the latter of the third substrate layer. A second transition device 28 is respectively placed between the other coupled guide channel of the fourth substrate layer and the coupled guide channel facing the latter of the third substrate layer. In particular, the dielectric interlayer 29 is placed between the third substrate layer and the fourth substrate layer. The transition devices 28 comprise two adaptation channels. Furthermore, the adaptation channels are orthogonal to the transmission direction.

Figure 13:
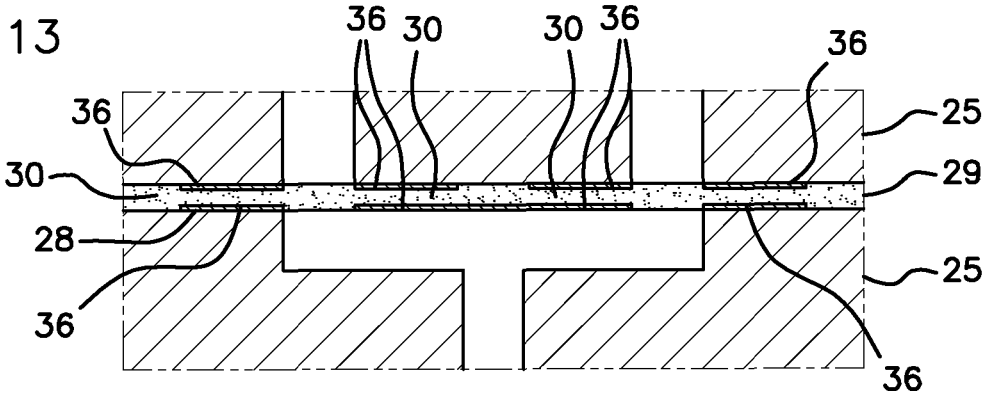

FIG. 13 presents a multilayer waveguide according to a variant of FIG. 12. The multilayer waveguide presents two substrate layers 25, a first substrate layer, called lower substrate layer, comprising a first guide channel extending according to a transmission direction and being connected to a second guide channel of the lower substrate layer orthogonal to the transmission direction. A second substrate layer, called upper substrate layer, comprises two guide channels.

A first guide channel of the upper substrate layer is coupled with one end of the second guide channel of the lower substrate layer. The second guide channel is coupled to the other end of the second guide channel of the lower substrate layer. For this purpose, the guide channels of the upper substrate layer are positioned opposite the ends of the second guide channel of the lower substrate layer. A first transition device 28 is placed between the first coupled guide channel of the upper substrate layer and the second guide channel of the lower substrate layer. A second transition device 28 is placed between the second coupled guide channel of the upper substrate layer and the second guide channel of the lower substrate layer. The transition devices 28 comprise two adaptation channels. The two transition devices 28 present a common adaptation wall between the ends of the second guide channel of the lower substrate layer so as to delimit this second guide channel and to enable the guidance of an electromagnetic wave in this second guide channel between its ends. In particular, the common adaptation wall consists of a metallized wall placed over the lower substrate layer.

Figure 14:
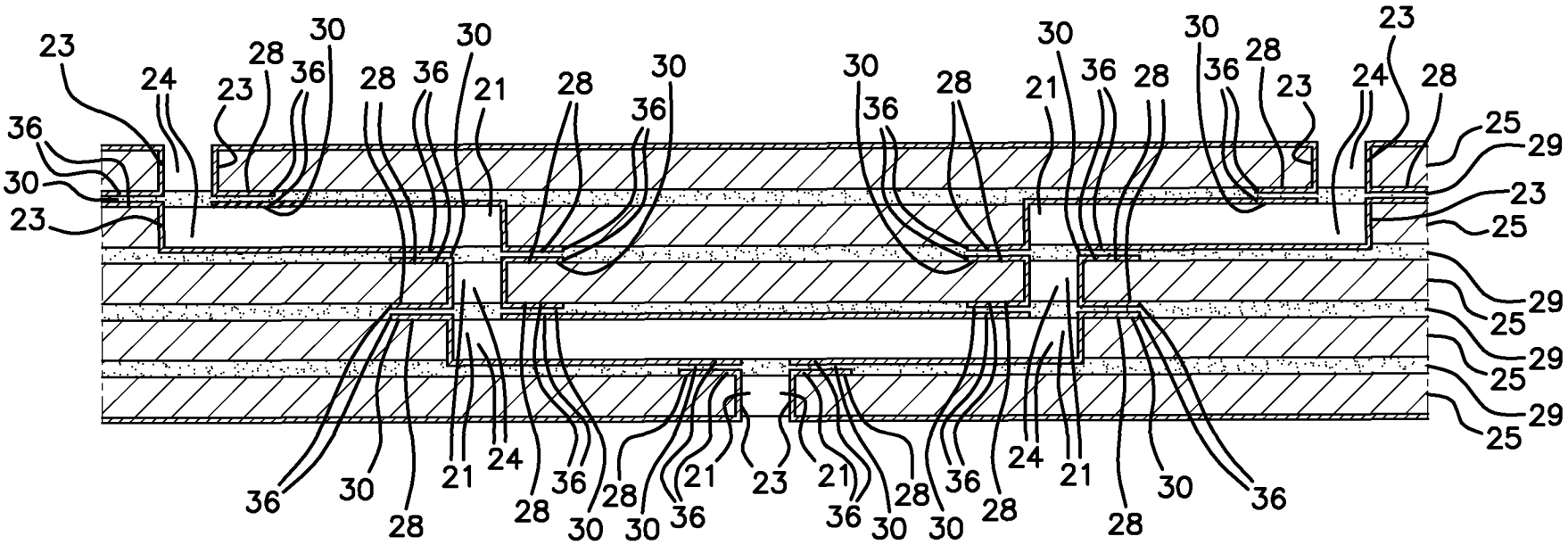
FIG. 14 is a schematic longitudinal sectional view of a multilayer waveguide according to form according to the present disclosure comprising five substrate layers forming a multilayer supply network called candlestick network.

FIG. 14 presents a multilayer waveguide according to the present disclosure comprising five substrate layers superimposed on each other allowing obtaining a supply network called candlestick network (see for example U.S. Pat. No. 7,432,871). A guide channel, extending according to a transmission direction, of the first substrate layer is coupled by a transition device to a guide channel, extending orthogonally to the transmission direction, from a second substrate layer to the first substrate layer. The transition device between the first and the second substrate layer comprises two adaptation channels. Each of these adaptation channels has an adaptation wall extending along the guide channel of the second substrate layer so as to delimit it. A first end of the guide channel of the second substrate layer is coupled by a transition device to a first guide channel, extending according to the transmission direction, of a third substrate layer. A second end of the guide channel of the second substrate layer is coupled by another transition device to a second guide channel, extending according to the transmission direction, of the third substrate layer. Each of the transition devices between the second and the third substrate layers has two adaptation channels, as represented in FIG. 11. A first guide channel of the third substrate layer is coupled to a first end of a first guide channel, extending orthogonally to the transmission direction, of a fourth substrate layer, as represented in FIG. 12. Similarly, a second guide channel of the third substrate layer is coupled to a first end of a second guide channel, extending orthogonally to the transmission direction, of a fourth substrate layer. A second end of the first guide channel of the fourth substrate layer is coupled by a transition device to a first guide channel, extending according to the transmission direction, of a fifth substrate layer. Furthermore, a second end of the second guide channel of the fourth substrate layer is coupled by a transition device to a second guide channel, extending according to the transmission direction, of the fifth substrate layer. In particular, each transition device between the fourth and the fifth substrate layer comprises two adaptation channels. Each guide channel of the fourth substrate layer is delimited by an adaptation wall of the adaptation channel to which it is associated.

A multilayer waveguide 20 according to the present disclosure may be incorporated into an antenna as represented in FIG. 15. The antenna is made by adding radiating slots on the upper face of the multilayer waveguide 20 represented for example in FIG. 14.

FIG. 16 presents a variant of the multilayer waveguide of FIG. 14. This multilayer waveguide differs from that presented in FIG. 14 in that the transition devices between the first substrate layer and the second substrate layer, between the third substrate layer and the fourth substrate layer and between the fourth substrate layer and the fifth substrate layer comprise one single adaptation channel.

A multilayer waveguide 20 according to the present disclosure whose layers 25 consist of plates for manufacturing a printed circuit board (PCB) may be manufactured by etching the adaptation walls 36 of the adaptation channels 30 across the electrically-conductive material thickness applied over at least one main face of the substrate of each layer 25. Thus, each adaptation wall 36 is formed of the electrically-conductive material of the layers 25. The guide walls 23, formed by vias 27 or metallic plates 26 are manufactured in the layers 25 of the multilayer waveguide by methods known to those skilled in the art. When the manufacture of the adaptation walls 36 and of the guide walls 23 on each layer 25 of the multilayer waveguide 20 is completed, the layers 25 of the multilayer waveguide 20 are assembled by interposing a dielectric interlayer 29 (adhesive film or air layer) between each of them.

A multilayer waveguide 20 according to the present disclosure may also be made by additive manufacturing of layers of polymer material and by deposition of an electrically-conductive material over at least one surface of the layers of polymer material. Afterwards, the adaptation walls 36 of the adaptation channels 30 are etched across the applied electrically-conductive material thickness. Once etched, the layers are then assembled to each other by bonding using an adhesive film.

A multilayer waveguide 20 according to the present disclosure may also be made from metallic parts delimiting the guide channels and the adaptation channels. The space between the metallic parts defining the guide channels or else the adaptation channels may be filled with air or else with a dielectric foam.

Hence, a multilayer waveguide 20 according to the present disclosure may be manufactured with methods known to those skilled in the art. Thus, the manufacture of a multilayer waveguide 20 is simple and rapid to implement.

Moreover, such a manufacturing method may be implemented for a mass production of multilayer waveguides according to the present disclosure.

Furthermore, the tolerance to manufacturing defects of a multilayer waveguide 20 according to the present disclosure allows facilitating the manufacture by providing for a margin for misalignment of the coupled guide channels.

Hence, the present disclosure concerns a multilayer waveguide 20 comprising a transition device 28 with two guide channels 21 extending in a multilayer waveguide 20, each guide channel 21 comprising at least two electrically-conductive walls. The transition device 28 allows improving the transmission of the electromagnetic waves between the guide channels 21, the transition device 28 comprising at least one adaptation channel 30, each adaptation channel 30 being delimited by two electrically-conductive walls.

A multilayer waveguide, a manufacturing method of such a multilayer waveguide and an antenna according to the present disclosure may be the object of numerous variants in connection with the forms represented in the figures.

In particular, each guide wall may be formed by a plurality of contiguous rows of vias. For example, the guide channel 21 may be delimited by four guide walls 23, each guide wall 23 being formed by at least one row, in particular at least two adjacent rows where the vias of one row are shifted according to the transmission direction with respect to the vias of another row of this guide wall 23, for example by three adjacent rows of vias 27 placed in a staggered way.

Furthermore, a multilayer waveguide according to the present disclosure may comprise guide walls formed by at least one row of vias and adaptation walls formed by at least one other row of vias.

A multilayer waveguide 20 according to the present disclosure may be used in order to design radars, satellite systems, circuits and antennas with multilayer waveguides operating up to millimeter-waves. In particular, a multilayer waveguide 20 according to the present disclosure allows making in particular antennas according to a CTS-type structure as represented in FIG. 15.

Unless otherwise expressly indicated herein, all numerical values indicating mechanical/thermal properties, compositional percentages, dimensions and/or tolerances, or other characteristics are to be understood as modified by the word "about" or "approximately" in describing the scope of the present disclosure. This modification is desired for various reasons including industrial practice, manufacturing technology, and testing capability.

As used herein, the phrase at least one of A, B, and C should be construed to mean a logical (A OR B OR C), using a non-exclusive logical OR, and should not be construed to mean "at least one of A, at least one of B, and at least one of C."

The description of the disclosure is merely exemplary in nature and, thus, variations that do not depart from the substance of the disclosure are intended to be within the scope of the disclosure. Such variations are not to be regarded as a departure from the spirit and scope of the disclosure.

The invention claimed is:

1. A multilayer electromagnetic waveguide comprising:

several superimposed layers forming guide channels for guiding an electromagnetic wave; and at least one transition device comprising at least one dielectric interlayer between two guide channels, provided as coupled guide channels, extending according to a direction of transmission of the electromagnetic wave between the coupled guide channels via the transition device, wherein each of the at least one transition device comprises at least one adaption channel extending from the coupled guide channels, according to a longitudinal direction secant to the transmission direction, wherein each of the at least one adaptation channel is delimited by at least two electrically-conductive walls, provided as adaptation walls, spaced from each other by the dielectric interlayer of the transition device, wherein each of the adaptation walls extend according to the longitudinal direction along the dielectric interlayer from one end, provided as coupling end, of one of the coupled guide channels, and at least one of the adaptation walls extend according to the longitudinal direction over a length selected between $0.1\lambda$ and $0.5\lambda$, to obtain an input impedance of at least substantially zero between the adaptation walls of the adaptation channel at level of the coupling ends of the coupled guide channels to optimize the transmission of the electromagnetic wave between the coupled guide channels.

2. The waveguide according to claim 1, wherein the longitudinal direction of each of the at least one adaptation channel is orthogonal to the transmission direction.

3. The waveguide according to claim 1, wherein at least one of the adaptation walls of the at least one adaptation channel includes a metallic blade.

4. The waveguide according to claim 1, wherein the at least one adaptation wall of the at least one adaptation channel is formed by a plurality of contiguous electrically-conductive vias parallel to each other.

5. The waveguide according to claim 4, wherein the vias extend along the dielectric interlayer from the coupling end.

6. The waveguide according to claim 4, wherein the vias extend along the dielectric interlayer orthogonally to the longitudinal direction of the at least one adaptation channel and to the transmission direction.

7. The waveguide according to claim 1, wherein the dielectric interlayer is interposed between two of the superimposed layers in which extend the coupled guide channels and in that each of the adaptation walls extends between the dielectric interlayer and one of the superimposed layers.

8. The waveguide according to claim 1, wherein each of the coupled guide channels is delimited by the at least two electrically-conductive walls, provided as guide walls, spaced from each other.

9. The waveguide according to claim 1, wherein each of the coupled guide channels is delimited by guide walls parallel in pairs and arranged to form a polygonal cross-section of the coupled guide channel.

10. The waveguide according to claim 1, wherein the at least one transition device comprises two of the at least one adaptation channel extending opposite to each other.

11. An antenna comprising at least one waveguide according to claim 1.

12. A method for manufacturing a multilayer electromagnetic waveguide comprising:

superimposing several layers to form guide channels for guiding an electromagnetic wave; and providing at least one transition device comprising at least one dielectric interlayer between two guide channels, provided as coupled guide channels, extending according to a direction of transmission of the electromagnetic wave between the coupled guide channels via the transition device, wherein each of the at least one transition device comprises at least one adaptation channel extending from the coupled guide channels, according to a longitudinal direction secant to the transmission direction, wherein each of the at least one adaptation channel is delimited by at least two electrically-conductive walls, provided as adaptation walls, spaced from each other by the dielectric interlayer of the transition device, wherein each of the adaptation walls extends according to the longitudinal direction along the dielectric interlayer from one end, provided as a coupling end, of one of the coupled guide channels, and at least one of the adaptation walls extends according to the longitudinal direction over a length selected so as to obtain an input impedance of at least substantially zero between the adaptation walls of the adaptation channel at a level of the coupling ends of the coupled guide channels to optimize the transmission of the electromagnetic wave between the coupled guide channels.

* * * * *